United States Patent [19]

Maczuszenko et al.

[11] Patent Number: 4,516,847

[45] Date of Patent: May 14, 1985

[54] ELECTROSTATIC PRINTING APPARATUS AND METHOD

[75] Inventors: Andrzej Maczuszenko, Etobicoke; Ernest Davison, Brockville; Brian Otter; Brian F. Whittaker, both of Toronto; Christopher Novak, Whitby; Dolf Landheer, Toronto, all of Canada

[73] Assignee: Delphax Systems, Mississauga, Canada

[21] Appl. No.: 446,759

[22] Filed: Dec. 3, 1982

[30] Foreign Application Priority Data

Dec. 4, 1981 [CA] Canada ..... 391561

[51] Int. Cl.[3] ..... G03G 15/16

[52] U.S. Cl. ..... 355/3 TR; 355/3 R

[58] Field of Search ..... 355/3 TR, 3 R, 3 SH; 101/DIG. 13

[56] References Cited

U.S. PATENT DOCUMENTS

| | | | |
|---|---|---|---|
| 3,751,156 | 8/1973 | Szostak et al. | 355/3 TR |
| 4,257,700 | 3/1981 | Tsuda et al. | 355/3 TR |
| 4,362,378 | 12/1982 | Erskine et al. | 355/3 TR |
| 4,415,257 | 11/1983 | Kopp et al. | 355/3 TR |
| 4,431,301 | 2/1984 | Hashimoto et al. | 355/3 TR |

*Primary Examiner*—R. L. Moses

*Attorney, Agent, or Firm*—Hirons, Rogers & Scott

[57] ABSTRACT

Apparatus is provided for printing on a receptor such as paper. An electrostatic image is formed on a dielectric-coated drum in a controlled environment to minimize the creation of chemical contaminants. The image is then toned by wiping toner over the image from a toner delivery system which includes a mouth shaped to cause a vortex in the toner to improve toner flow. After toning the image is transferred to the receptor under pressure from a roller which is skewed with reference to the drum. The pressure in the nip is sufficient to also cause the toner to be fused to the receptor. An image eraser is also provided in the controlled environment.

6 Claims, 17 Drawing Figures

ELECTROSTATIC PRINTING APPARATUS AND METHOD

FIELD OF THE INVENTION

The present invention relates to apparatus for and methods of electrostatic printing and, more particularly, to electrostatic printing in which a latent electrostatic image is formed on the periphery of an electrostatically chargeable drum by the deposition of ions on the drum periphery.

DESCRIPTION OF THE PRIOR ART

In U.S. Pat. Ser. No. 4,155,093, issued May 15, 1979 to Richard A. Fotland et al, there is disclosed a method and apparatus for the generation of charged particles by extracting them from a high density source provided with an electrical gas breakdown in an electric field between two conducting electrodes separated by an insulator. By the application of a high frequency electric field, high ion count densities can be obtained for use in forming an electrostatic image.

In addition, the aforesaid patent discloses a matrix ion generator for the formation of dot matrix characters on a dielectric surface.

U.S. Pat. Ser. No. 4,267,556, issued May 12, 1981 to Richard A. Fotland et al, discloses a multiplexed ion generator with slanted finger electrodes and selector bars.

U.S. Pat. Ser. No. 4,160,257, issued July 3, 1979 to Jeffrey J. Carrish discloses, in addition, the use of a 'screen' electrode for improving the operation of the ion generator.

It is found, in practice, that when an ion generator embodying the teachings of the aforementioned prior United States patents is employed to form a latent electrostatic image on the dielectric surface of a rotatable electrostatically chargeable drum, the electrical discharge at the ion generator in the vicinity of the periphery of the drum can produce chemical contaminants which have a deleterious effect on the ion generator and the drum periphery.

Also, the ion generator must be located at an accurately predetermined spacing from the periphery of the drum. It is therefore essential for a commercial machine to provide simple means for replacing the ion generator while maintaining this spacing.

In addition, when the ion generator is incorporated with means for erasing a residual electrostatic image from the drum periphery, it is found that chemical pollutants may also be produced by the erase means, which likewise have a deleterious effect.

Other problems arise in connection with the application of toner powder to an electrostatic image on a drum periphery. For example, single component magnetic toner powder is a fine, dense powder, which settles rapidly and excludes air and which then will not flow freely and completely from a hopper. Such compacted toner powder tends to form arches, which may be interrupted by localized funnel flow. Consequently, a magnetic toner powder applicator roller for applying the toner powder from the hopper to the periphery of the drum tends to have insufficient powder supplied to areas of the applicator roller which coincide with the arches. Vibration of the hopper further compacts the toner powder, causing stronger arches and poorer toner powder flow.

Also, toner powder tends to form lumps or agglomerations, which can become lodged in the outlet from the hopper and prevent the uniform flow of toner powder to the applicator roller, causing circumferential depressed bands to form in the toner pile around the toner applicator roller and consequential untoned bands along the copy material.

The toner is transferred to paper or the other such medium at a nip between the drum and the pressure roller. This nip must exert a controlled pressure and simple means are needed to permit the drum and roller to be separated to remove paper jams.

These and other problems in the art are addressed by the present invention.

BRIEF SUMMARY OF THE INVENTION

It is accordingly an object of the present invention to provide a novel and improved electrostatic printing apparatus employing an ion generator for forming a latent electrostatic image on an electrostatically chargeable drum in which a controlled environment is provided in the vicinity of the ion generator and the drum periphery to counteract the effect of chemical contaminants.

It is a further object of the present invention to provide an electrostatic printing apparatus employing an electrostatically chargeable drum and means for heating the drum periphery to counteract condensation of chemical contaminants thereon.

It is a further object of the present invention to provide an electrostatic printing apparatus in which a stream of heated and dehumidified air is provided between an ion generator and the periphery of an electrostatically chargeable drum to carry away chemical contaminants.

It is a still further object of the present invention to provide improved means for causing constant agitation of a toner powder in a region where the powder is supplied to a toner powder applicator roller.

Yet another object of the present invention is to provide a novel and improved electrostatic printing apparatus enabling simple and accurate adjustment of the spacing between an ion generator and the periphery of an electrostatically chargeable drum.

According to one aspect of the present invention, there is provided, in an electrostatic printing apparatus comprising a rotatable electrostatically chargeable drum and ion deposition means for forming an electrostatic image on the electrostatically chargeable drum, the improvement comprising means for discharging a flow of air along the path of flow extending between the periphery of the electrostatically chargeable drum and the ion discharge means.

The invention further provides an electrostatic printing apparatus comprising an electrostatically chargeable drum, means for forming an electrostatic image on the drum and means for erasing the electrostatic image from the drum, in which means are provided for discharging a flow of air along the path of flow extending between the periphery of the drum and the erase means.

The invention still further provides an electrostatic printing apparatus comprising a rotatable electrostatically chargeable drum and means for forming an electrostatic image on the electrostatically chargeable drum, in which means are provided for heating the drum.

As described in greater detail below, the preferred embodiment of the present invention employs a flow of dehumidified and heated air which is discharged, so as to impinge on the periphery of the electrostatically chargeable drum, at a region between the drum, on the one hand, and the ion deposition means and erase means, on the other hand, an enclosure being formed around this region for counteracting escape of the air flow in undesired directions from such region.

The dehumidified and heated air fulfills two functions. Firstly, it provides an environment which minimizes the development of chemical contaminants; it carries away from the above-mentioned region any chemical contaminants produced by the ion deposition means and, in particular, by the erase means, and thirdly, the heated air impinges against and thus heats the drum periphery, which counteracts condensation of the chemical contaminants on the drum periphery.

The present invention further provides a method of electrostatic printing which comprises, in succession, depositing ions onto a dielectic surface to form an electrostatic image, applying toner powder to said electrostatic image to form a toner image, transferring and fusing said toner image to a copy material, removing residual toner powder from said dielectric surface and removing said electrostatic image from said dielectric surface at an erase region while maintaining a controlled atmosphere environment at said erase region.

According to yet another aspect of the present invention, there is provided, in an electrostatic printing apparatus including an electrostatically chargeable cylinder, a toner applicator cylinder for applying a toner powder to the periphery of said electrostatically chargeable cylinder and a toner powder hopper for supplying a toner powder to said toner applicator cylinder, said electrostatically chargeable cylinder and said toner applicator cylinder being arranged to rotate in opposite directions of rotation, the improvement comprising means defining a downwardly open outlet from said toner powder hopper, said outlet defining means comprising first and second walls extending longitudinally of said toner applicator cylinder, said first wall having a lower edge forming a doctor blade for toner powder adhering to the periphery of said toner applicator cylinder, and said second wall being spaced rearwardly from said first wall with respect to the direction of rotation of said toner applicator cylinder and being arranged to retain the toner powder, said first wall having a surface facing inwardly of said outlet means and angled relative to said toner applicator cylinder so as to cause toner powder entrained by said toner applicator roller to rise within said outlet means and thereby to be agitated.

In practice, the first wall surface may be arranged to produce a motion in the toner powder which may be described as a horizontal vortex, around which the toner powder travels, thus counteracting the formation of arches and lumps in the toner powder.

The present invention still further provides, in an electrostatic printing apparatus including an electrostatically chargeable cylinder and ion deposition means for forming an electrostatic image on said drum, the improvement comprising means for readily releasably supporting said ion deposition means in position relative to the periphery of said electrostatically chargeable cylinder and means for adjusting the position of said support means and therewith said ion deposition means relative to said cylinder periphery.

These and other aspects of the invention will be better understood with reference to the following description and associated drawings.

BRIEF DESCRIPTION OF THE DRAWINGS

A preferred embodiment of the invention is shown in the accompanying drawings, in which.

DESCRIPTION OF THE PREFERRED EMBODIMENT

Figure 1:
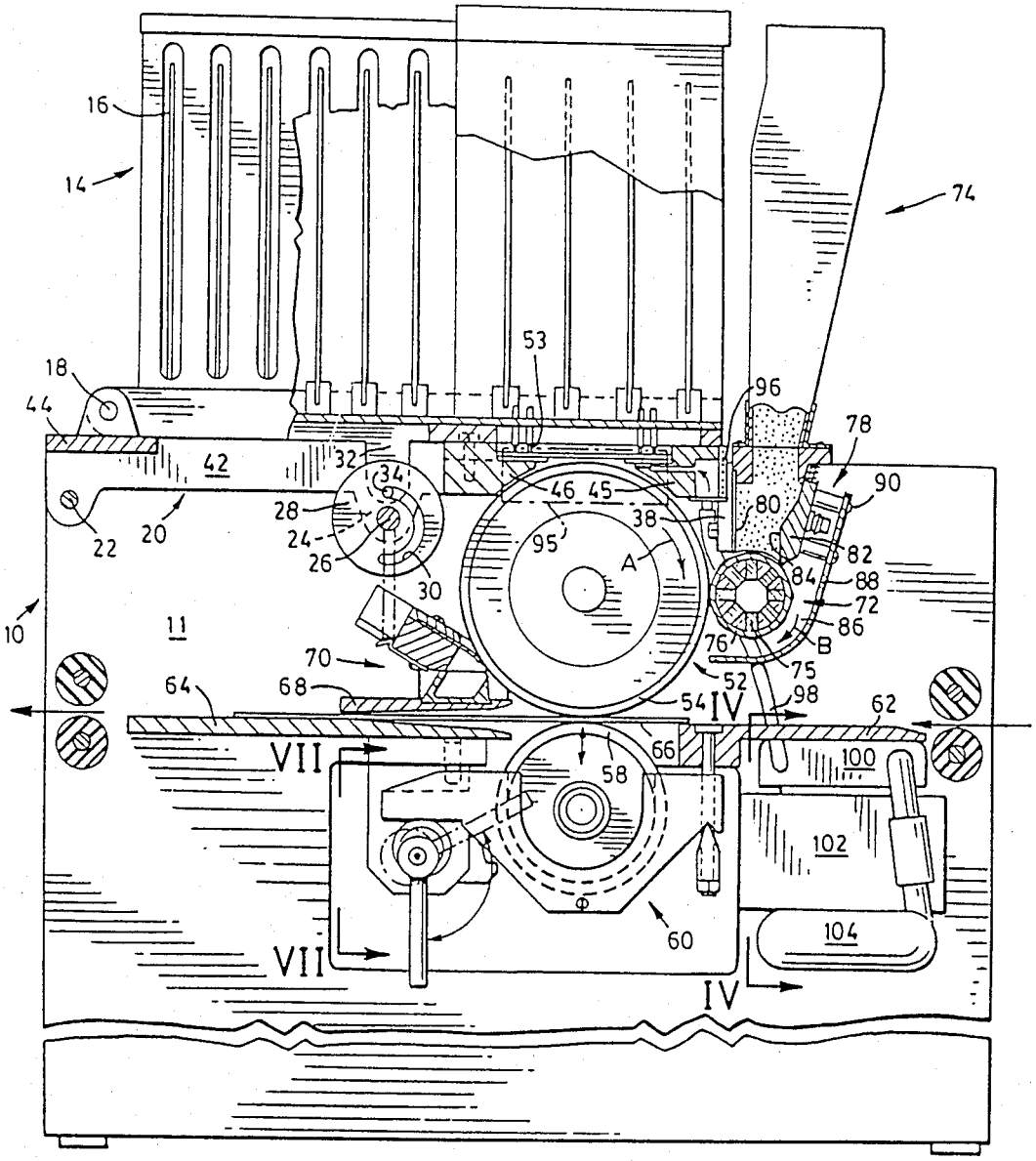
FIG. 1 is a side view, most of which is a vertical cross-section through an electrostatic printing apparatus embodying the present invention.
Figure 2:
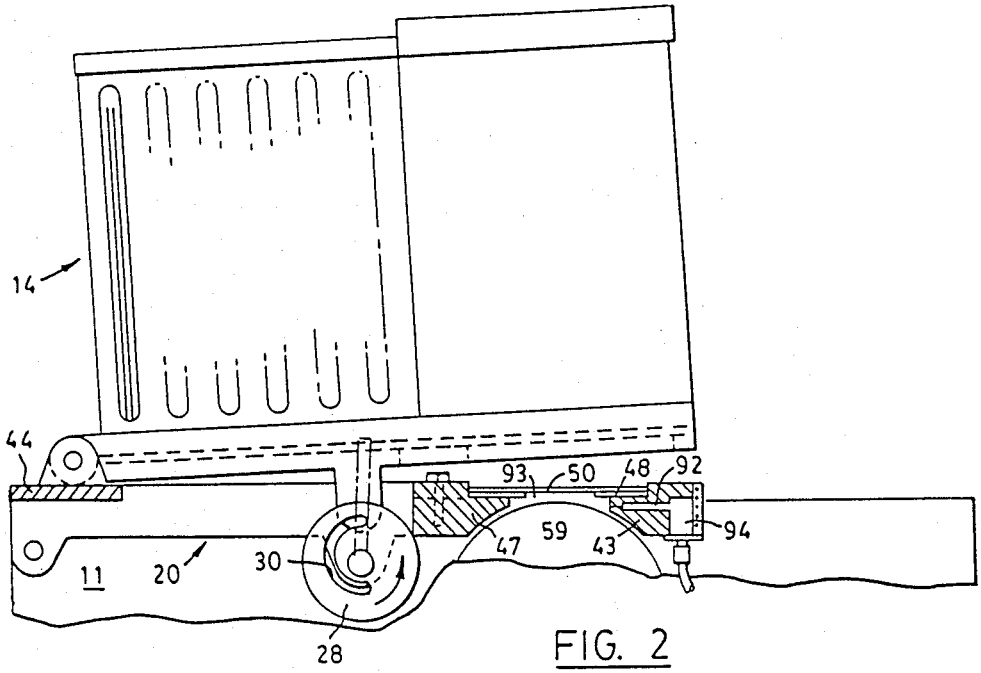
FIG. 2 is also a side view partly in vertical cross-section, of parts of the apparatus of FIG. 1 in a position providing access for inserting and removing an insert carrying anion deposition matrix.
Figures 3, 3A:
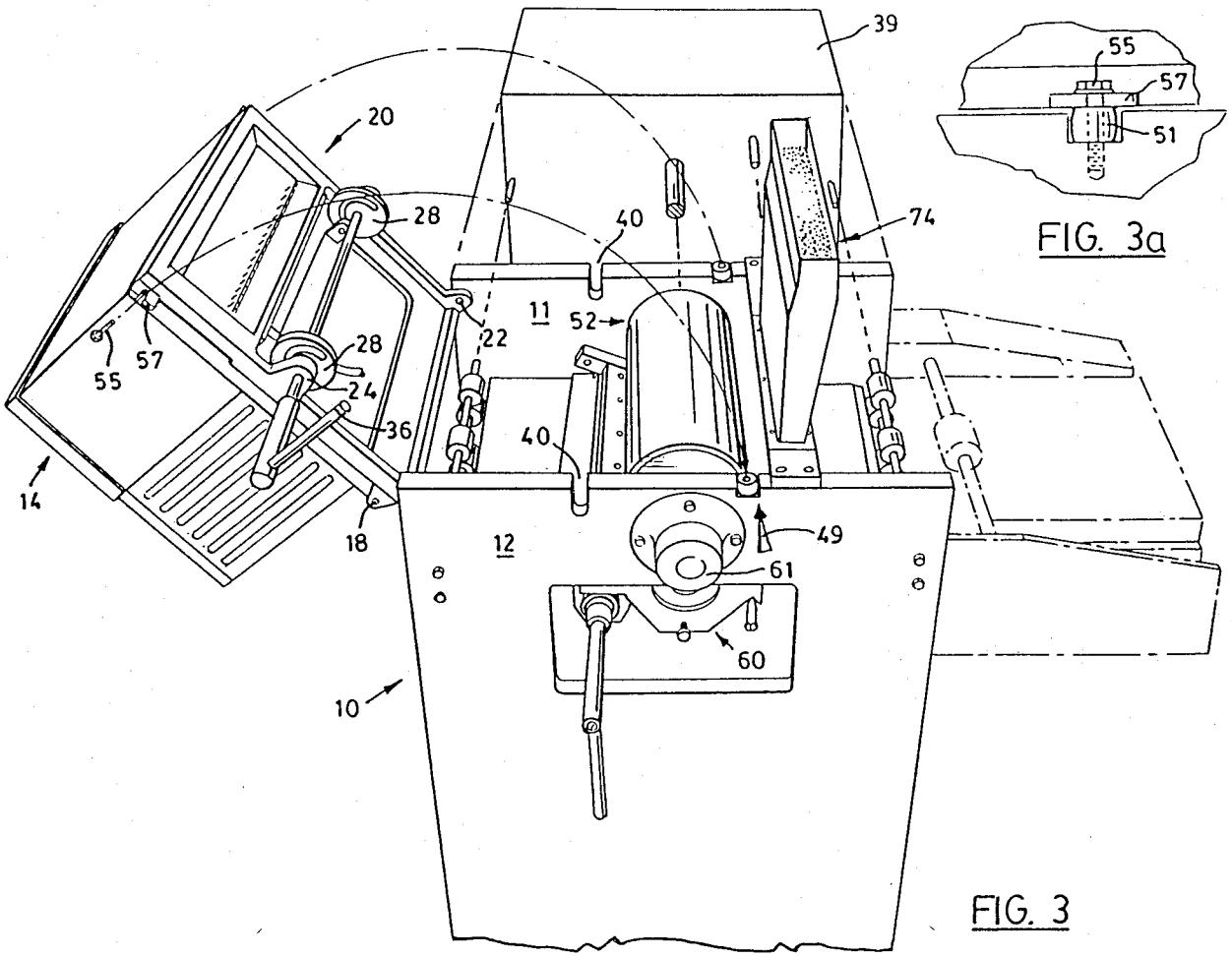
FIG. 3 is a view in perspective drawn generally from above the apparatus of FIG. 1 and shown in a position providing access to the paper path.
FIG. 3*a* is a side view, drawn to an enlarged scale, of a part of the apparatus.

Referring firstly to FIGS. 1–3 of the accompanying drawings, an electrostatic printing apparatus indicated generally by reference numeral 10 has a pair of opposed side walls 11 and 12, which support a housing indicated generally by reference numeral 14, the housing 14 containing a plurality of printed circuit boards 16 for controlling the operation of the apparatus.

The housing 14 is pivotally supported by a pair of pivots, which are arranged at opposite sides of the housing 14 and only one of which is shown and is indicated by reference numeral 18, these pivots providing a pivotal connection between the housing 14 and a pivotal support frame 20.

The pivotal support frame 20 is, in turn, pivotally mounted on the side walls 11 and 12 by a pair of pivots 22 and is provided with a pair of depending lugs 24, at opposite sides of the pivotal support frame 20, for rotatably supporting a shaft 26.

The shaft 26 has, fixedly connected thereto, a pair of circular cams 28, each of which is formed with a cam slot 30 which is curved eccentrically with respect to the longitudinal axis of the shaft 26.

The housing 14 is provided, at the underside thereof, with a pair of depending lugs 32, each of which has a laterally projecting cam follower pin 34 slidably engaging in a respective one of the cam slots 30.

By means of a handle 36, the shaft 26 is manually rotatable to rotate the cams 28, about the axis of the shaft 26, between the position in which one of the cams 28 is illustrated in FIG. 1 and the position in which it is shown in FIG. 2.

In the cam position illustrated in FIG. 1, the housing 14 is rotated, in a clockwise direction as viewed in FIG. 1, about the pivots 18 into a fully lowered or operational position.

When the shaft 26 is rotated in an anticlockwise direction, as viewed in FIGS. 1 and 2, to pivot the cams 28 into the position shown in FIG. 2, the housing 14 is thereby pivoted upwardly, about the pivots 18, into the position in which it is shown in FIG. 2, to provide a gap between the front ends of the housing 14 and the pivotal support frame 20.

The side walls 11 and 12 are formed with vertically open notches 40 (FIG. 3) for receiving the shaft 26 when the pivotal support frame 20 is in the lowered position in which it is shown in FIGS. 1 and 2.

As illustrated in FIG. 3, the pivotal support frame 20, and therewith the housing 14, can be pivoted about the pivots 22 to remove the shaft 26 from the notches 40 and to dispose the pivotal support frame 20 and the housing 14 in a rearward position, in which they are shown in FIG. 3, to provide access to the interior of the electrostatic printing apparatus 10 between the side walls 11 and 12.

The pivotal support frame 20 is formed by opposed side frame members 42, which extend parallel to the side walls 11 and 12, a rear transverse frame member 44, a front transverse frame member 45 and an intermediate transverse frame member 46, the transverse frame members 45 and 46 being formed with shoulders 43 and 47 defining, in the top of the pivotal support frame 20 and adjacent the front thereof, a rectangular recess 48 which is dimensioned for snugly receiving and thereby accurately locating an ion deposition matrix and an electrostatic erase head in the form of a rectangular sheet-shaped insert or printing unit 50.

The housing 14 is provided, above the recess 48, with a plurality of pins 53 which are spring-biased in a downward direction and which, in the lowered, operational position of the housing 14 shown in FIG. 1, press against the upper surface of the insert 50, above the shoulders 43 and 47 of the front and intermediate transverse members 45 and 46, to ensure that the printing insert 50 is accurately located in position in the recess 48 relative to the pivotal support frame 20. More particularly, the printing insert 50 is accurately located, in this manner, relative to the periphery of an electrostatically chargeable drum or image cylinder indicated generally by reference numeral 52, the outer surface of which is formed by a cylindrical dielectric layer 54, the electrostatically chargeable drum 52 being mounted on a shaft 56 which, in turn, is journalled at opposite ends thereof in bearings mounted on the side walls 11 and 12, only one of the bearings being shown and being indicated in FIG. 3 by reference numeral 61.

The pivotal support frame 20 is accurately located, by the means described below with reference to FIG. 3*a*, relative to the side walls 11 and 12 of the apparatus and thus relative to the axis of the electrostatically chargeable drum 52. Consequently, when the insert 50 is pressed downwardly against the bottom surface of the recess 48 by the pins 53, the insert 50 will be positioned at an accurate spacing, measured radially of the electrostatically chargeable drum 52 and thus perpendicular to the plane of the bottom surface of the recess 48, from the periphery of the electrostatically chargeable drum 52.

FIG. 3 also illustrates diagrammatically a drive system 39 used to drive the drum 52 and other various driven parts of the apparatus as will be apparent from further description.

FIG. 3*a*, which shows a fragmentary portion indicated by arrow 49 in FIG. 3, illustrates one of a pair of rubber abutments 51 for supporting the pivotal support frame 20 relative to the side walls 10 and 11. The pivotal support frame has a pair of laterally projecting lugs 57, of which only one is shown and each of which is formed with openings for receiving a securing bolt 55, which extends through the respective rubber abutment 51 into threaded engagement with the respective side wall. By tightening these securing bolts and thus compressing the rubber abutments to a greater or lesser extent, the position of the pivotal support frame 20, and thus the printing insert 50, can be adjusted accurately relative to the electrostatically chargeable drum 52.

The bottom surface of the recess 48 is formed with a rectangular opening 59 through which the insert 50 faces the periphery of the electrostatically chargeable drum 52 for forming and erasing an electrostatic image on the dielectric peripheral surface of the drum, the longitudinal dimension of the rectangular insert 50 and opening 59 extending parallel to the axis of the drum. The insert 50 has marginal edge portions which extend beyond the opening 59, at opposite sides and opposite ends of the opening 59, to rest on the bottom surface of the recess 48, i.e. on the shoulders 43 and 47 and on corresponding shoulders (not shown) on the side frame members 42, the pins 53 engaging the tops of these marginal portions and pressing downwardly on the insert 50 above these shoulders.

The pins 53 also serve as electrical contacts for connecting the printed circuit boards 16 to the insert 50 and must therefore be accurately positioned, in the plane of the insert 50, relative to corresponding contact areas on the top surface of the insert 50. This is ensured, in the present embodiment, by giving the insert 50 an accurate fit between the side walls of the recess. Other alternative arrangements for achieving this, e.g. using one each of the side and end walls of the recess 48 as reference planes and spring biasing the insert against such side walls or providing the recess 48 and the insert 50 with interengagable projections and recesses, will be readily apparent to those skilled in the art.

The electrostatic printing drum 52 cooperates with an underlying pressure cylinder or roller 58, which is rotatably mounted in a pair of cradles 60, one of which is shown in FIG. 1 and which are adjustable in position, in a vertical direction, relative to the electrostatic printing drum 52 in a manner described in greater detail hereinafter.

As seen in FIG. 1, front and rear paper support plates 62 and 64 extend transversely between the side walls 11 and 12 and serve to guide a sheet 66 of copy paper through the nip between the electrostatic printing drum 52 and the pressure roller 58 for simultaneously transferring and fusing a toner image onto the copy paper sheet 66.

The toner powder is transferred and fused onto the sheet 66 by high pressure applied between drum 52 and roller 58 without electrostatic aid as will be described in greater detail later.

The dielectric layer 54 of the drum 52 has sufficiently high resistance to support the latent electrostatic image during the period between latent image formation and toning. Consequently, the resistivity of the layer 54 must be in excess of $10^{12}$ ohm-centimeters. The preferred thickness of the insulating layer 54 is 0.001 to 0.002 inches. In addition, the surface of the layer 54 should be highly resistant to abrasion and relatively smooth, with a finish that is preferably better than 20 microinch rms. The smoothness of dielectric layer 54 contributes to the efficiency of toner transfer to the copy paper sheet 66. The dielectric coated drum 52 additionally has a high modulus of elasticity, typically on the order of $10^7$ PSI, so that it is not distorted significantly by high pressures in the transfer nip.

A number of organic and inorganic dielectric materials are suitable for the layer 54. Glass enamel, for example, may be deposited and fused to the surface of a steel or aluminum cylinder. Flame or plasma sprayed high density aluminum oxide may also be employed in place of glass enamel. Plastic materials, such as polyimides, nylons, and other tough thermoplastic or thermoset resins, are also suitable. However, in this the preferred embodiment, the dielectric layer 54 is formed by making the drum 52 as an aluminum cylinder having an anodized surface of aluminum oxide and by then dehydrating the aluminum cylinder and impregnating surface apertures in the cylinder with zinc stearate.

The pressure roller 58 consists of a metallic core having an outer covering of nylon or other engineering plastic such as a polyester. The covering has a thickness in the range $\frac{1}{8}$ to $\frac{1}{2}$ inch. The surface material of roller 58 typically has a modulus of elasticity on the order of 200,000–450,000 PSI. The copy paper sheet 66 will tend to adhere to the pressure roller 58 in preference to the dielectric layer 54 because of the relatively high smoothness and modulus of elasticity of the latter. One function of this coating on the pressure roller 58 is to bind copy paper sheet 66 when the latter is subjected to a speed differential between the roller surfaces and another is to absorb any high stresses introduced into the nip in the case of a paper jam or wrinkle, so that the dielectric coated drum 52 will not be damaged thereby.

The pressure required for good fusing to plain paper is governed by such factors as, for example, roller diameter, the toner employed, and the presence of any coating on the surface of the paper.

Returning to FIG. 1, the paper is also guided by an upper guide plate 58, disposed above the front end of the rear support plate 64 and adjacent the periphery of the electrostatic printing drum 52. This plate guides the copy paper sheet 66, when necessary, from the electrostatic printing drum 52 and across the rear paper support plate 64 and, in addition, serves to support a scraper 70 for removing residual toner powder from the periphery of the electrostatic printing drum 52. Driver input rollers 67 and output roller 69 serve to feed the copy paper sheet 66 to and from the drum 52.

Figure 9:
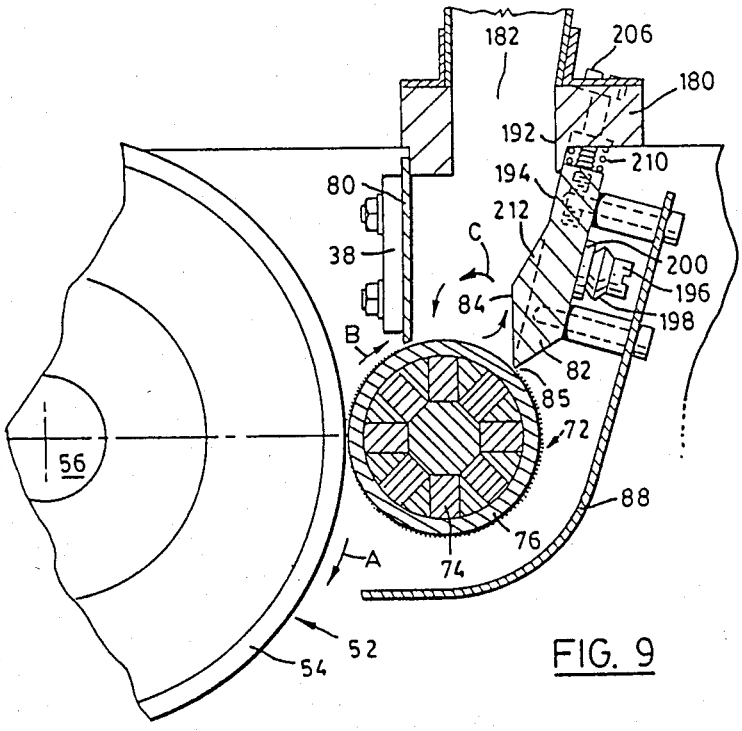
FIG. 9 is a view in vertical cross-section through a toner powder applicator roller and toner powder hopper outlet forming parts of the apparatus of FIG. 1 and drawn to a larger scale.

Reference is next made to FIGS. 1 and 9 to describe the toner powder feed. The toner powder is applied to the periphery of the electrostatic printing drum 52, which rotates in the direction indicated by arrow A, by means of a toner applicator roller indicated generally by reference numeral 72, which rotates in the opposite direction indicated by arrow B and receives toner powder from a hopper indicated generally by reference numeral 74 mounted on the tops of the side walls 11 and 12.

The toner applicator roller 72 comprises a plurality of stationary magnets 75 and a rotatable cylinder 76 extending around the magnets 75 and is located below a toner outlet opening defined by the bottom of a toner hopper outlet indicated generally by reference numeral 78.

More particularly, the toner hopper outlet 78 comprises a fixed rear wall 80 and an adjustable front wall 82, which is formed with a rear face 84, facing inwardly of the toner hopper outlet and extending downwardly to a doctor blade or edge 85 in promixity to the periphery of the toner applicator roller cylinder 76.

On rotation of the toner applicator roller cylinder 76 in the direction indicated by an arrow B, the toner powder is caused by the magnets 75 to adhere to the periphery of the cylinder 76 and is carried around therewith, the amount of the powder withdrawn from the toner hopper outlet 78 by the toner applicator roller 72 being determined by the spacing of the bottom of the doctor blade 85 from the cylinder 76.

In addition, the toner powder which remains within the toner hopper outlet 78 is constantly agitated by rotation of the cylinder 76.

More particularly, the toner powder at the bottom of the toner hopper outlet 78 is displaced by the rotating cylinder 76 in the peripheral direction of the latter but cannot all pass below the doctor blade 85. Therefore, some of this displaced powder is deflected upwardly by the face 84 of the front wall 82. This upwardly deflected powder then circulates, in the manner of a horizontal vortex and as indicated by arrows C (FIG. 9), to produce a constant agitation of the toner powder in the toner hopper outlet 78. Such agitiation prevents the phenomena of arching and agglomeration of the toner powder in the toner hopper outlet 78 which, as known to those skilled in the art, can be troublesome, in particular, when a single component toner powder is employed. This agitation is enhanced by a preferred arrangement of magnets and toner hopper parts. The magnets drawn in this arrangement are satisfactory and are used in this arrangement because they are readily available this way. However it has been found that the effect is enhanced if the doctor blade edge lies at about 60 degrees outwardly from vertical with reference to the axis of the cylinder 76 and the lower edge of the wall 80 lies at about 15 degrees inwardly with respect to the same axis. Ideally there should be a magnet adjacent each of these lower edges. Further, both the wall 80 and the rear face 84 of the doctor blade should be vertical although the face 84 can be tilted inwardly in the range 0–7 degrees without significantly affecting the formation of the vortex.

A deflector plate 88, secured by bolts 90 to the adjustable front wall 82 of the hopper, extends laterally and underneath the toner applicator roller 72, at a spacing from the periphery of the cylinder 76, to a position close to the periphery of the electrostatically chargeable drum 52. The deflector plate 88 serves to deflect downwardly towards the nip between the drum 52 and roller 58 the leading edge of any incoming sheet of copy paper which becomes incorrectly deflected towards the toner applicator roller 72. In addition, the deflector plate 88 serves to direct a flow of air, entrained by the rotation of the toner applicator roller cylinder 76, which rotates at approximately 350 r.p.m., and the toner powder adhering to the cylinder 76, towards the periphery of the electrostatically chargeable drum 52, so that any loose toner powder in the vicinity of the cylinder 76 is carried towards the periphery of the drum 52 instead of contaminating the interior of the apparatus and the copy paper.

As indicated in FIG. 2, the front transverse frame member 45 is formed with a plurality of air discharge passages 92 spaced apart along the length of the electrostatically chargeable drum 52 for discharging a stream of dehumidified and preheated air in a direction generally tangential to the drum periphery and in a direction opposite to the direction of rotation of the drum so as to impinge on the drum periphery and pass along a path of flow extending through a gap 93 between the periphery of the electrostatic printing drum 52 and the printing unit 50.

To prevent this discharged air from escaping between the drum periphery and the underside of the shoulder 43 of the transverse member 45, the underside of the shoulder 43 is shaped to conform and extend closely to the drum periphery so that only a very narrow spacing, preferably about 0.001 inch, exists therebetween. The underside of the shoulder 43 and the drum periphery thus form a constriction at one side of the gap 93 which also prevents injection of air caused by entrapment with air flowing from the passages 92 into the gap 93.

Opposite ends of the gap 93 are closed to prevent escape of the discharged air at opposite ends of the drum by side walls, of which only one is shown, and is indicated by reference numeral 95, which extend between the transverse members 45 and 46 in close proximity to the ends of the drum.

The gap 93 is thus an enclosure in which a controlled atmospheric environment is maintained to minimize creation of chemical contaminants by the operation of the insert and to carry away any such contaminants which may be formed in the vicinity of the gap 93. Also, the impingement of the hot air on the drum periphery heats the drum, preferably to about 38°–42° C., and thus counteracts the deposition of condensation products of such chemicals on the drum periphery.

The air discharge passage 92 communicates, through an air preheating chamber 94, one wall of which is formed by an electrical resistance heater 96, with an air supply pipe 98 extending from a preheater unit 100 located as shown in FIG. 1 beneath the paper support plate 64. The preheater unit 100 is mounted above a condenser 102 which, in turn, is mounted above an air impeller 104.

Figure 4:
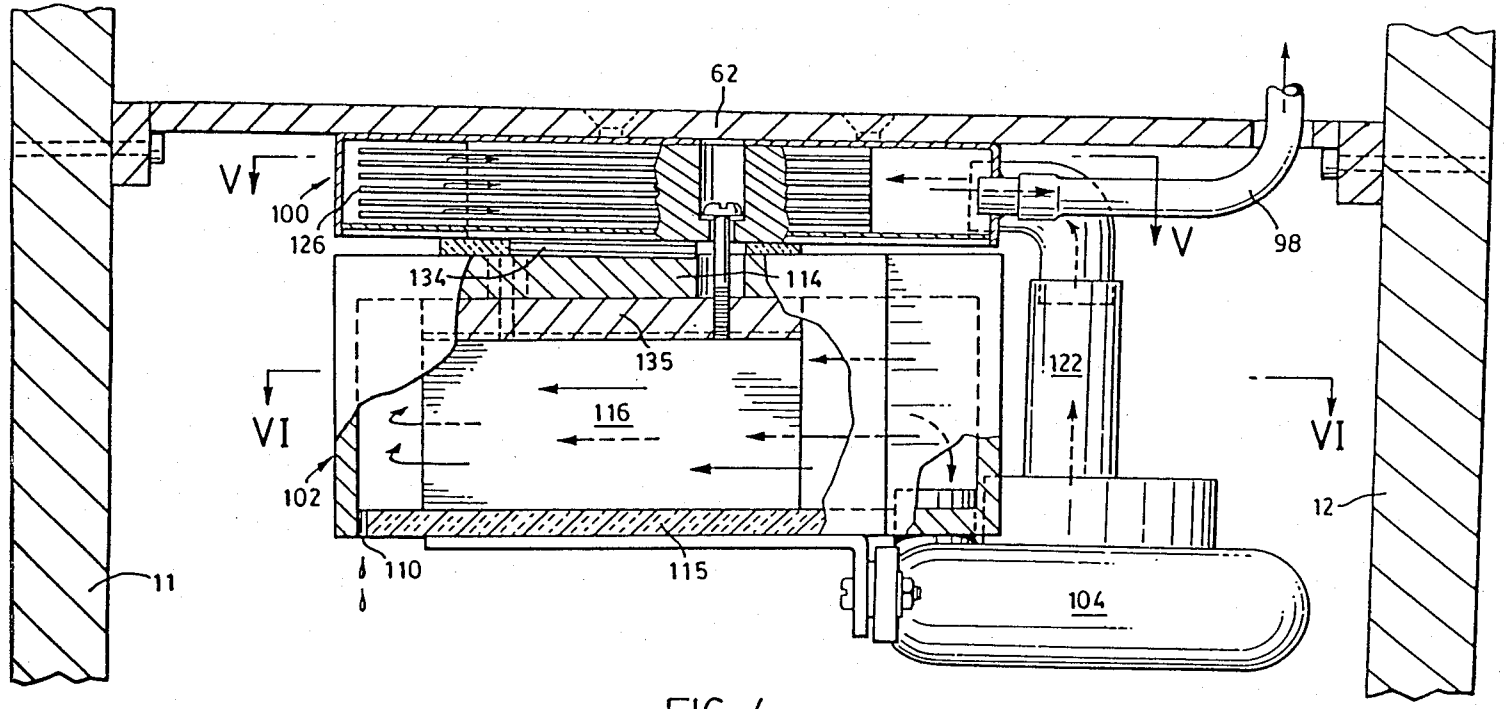
FIG. 4 is a vertical cross-section along the line IV—IV of FIG. 1 and illustrating an air dehumidifying and preheating arrangement with parts cut away to show structural details.
Figure 6:
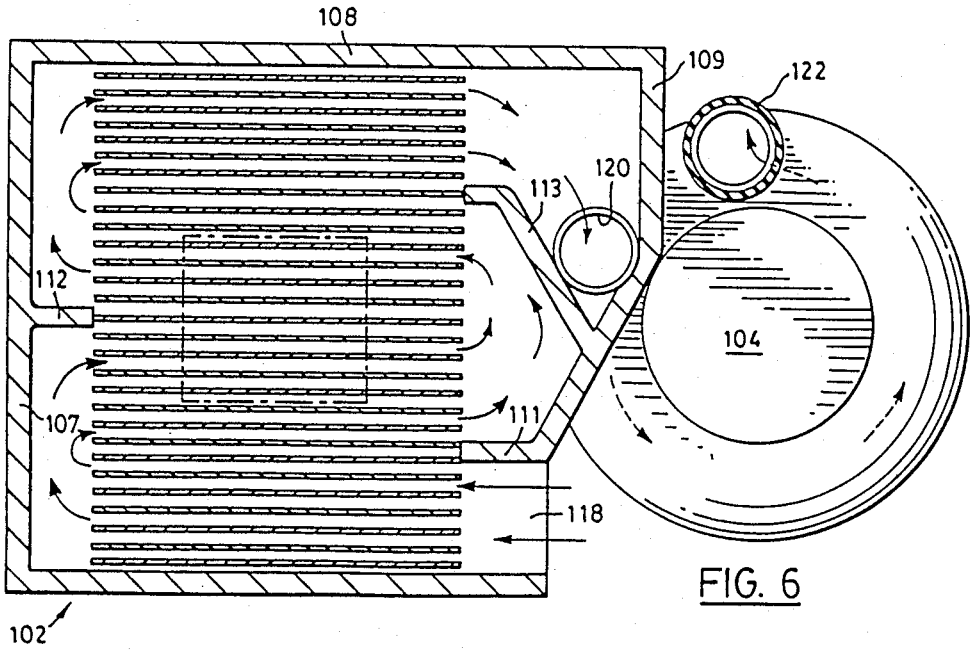

Referring now to FIG. 6, the condenser 102 has a housing comprising exterior walls 106 through 109, interior baffle walls 111 through 113, and as seen in FIG. 4, top 114 and a bottom 115 having a condensate outlet opening 110. A plurality of condenser plates 116 are spaced apart across the interior of the housing and extend parallel to the walls 106 and 108. The baffle wall 111, the wall 106, the top 114 and the bottom 115, combine to define an air inlet opening 118 for the entry of air from the surrounding atmosphere into the condenser 102. This air is drawn into the condenser 102 by the air impeller 104 and flows, in a labyrinth path indicated by the arrows in FIG. 6, between the condenser plates 116 to an air inlet opening 120 of the air impeller 104.

Figure 5:
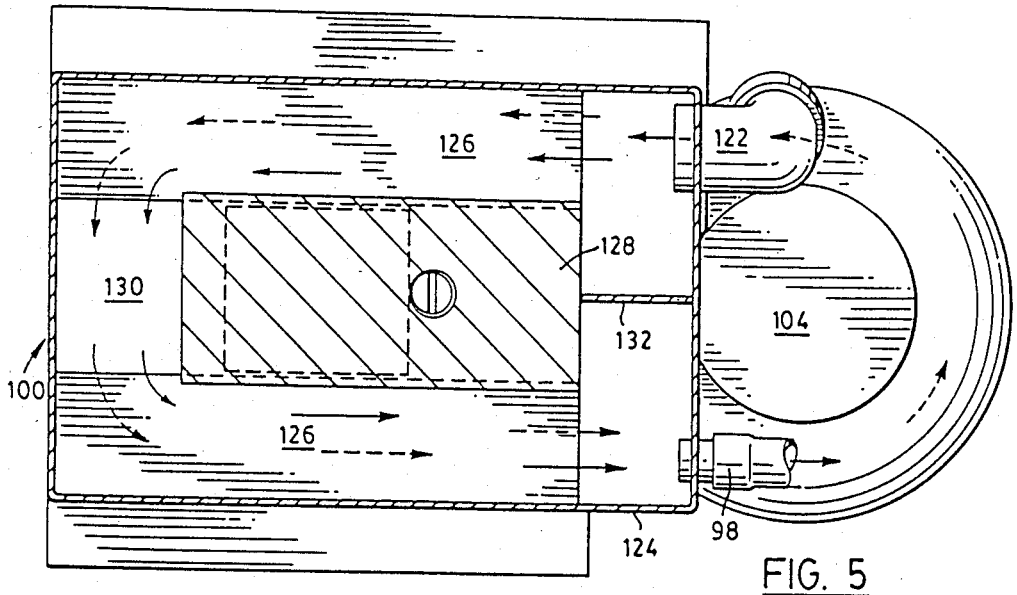
FIGS. 5 and 6 are top views taken in cross-section along the lines V—V and VI—VI, respectively, of FIG. 4.

The air impeller 104 has an outlet duct 122 communicating, as shown in FIG. 5, with the interior of the preheater unit 100.

The preheater unit 100 has a housing 124 which contains two spaced-apart sets of horizontal heater plates 126, the individual plates 126 of each set being vertically spaced, as shown in FIG. 4, to provide air passage therebetween. A plate support block 128 located between the two sets of plates 126 supports these plates and has a length less than that of the plates 126 to provide, at the end of the plate support block 128 remote from the duct 122, a free space 130 through which the air can flow from one of the plate sets to the other, a partition wall 132 being provided between the housing 124 and the other end of the plate support block 128 to ensure that the air must flow between the plates 126. The air flows in this manner, as indicated by arrows in FIG. 5, between the plates of the two sets and then leaves the preheater unit 100 through the pipe 98.

The plates 126 are heated, and the condenser plates are cooled, by means of a Peltier effect thermoelectric heat exchange device 134, which is interposed between the bottom of the preheater unit support block 128 and the top 114 of the condenser, serves to apply heat to the plate support block 128 of the preheater unit 100 and to extract heat from the condenser top 114.

The plate support block 128 forms a heat sink for heating the plates 126 and the condenser top 114 draws heat from the condenser plates 116 through a horizontal plate 135, in which the condenser plates 116 are slotted and which is in face-to-face contact with the condenser top 114.

Figure 7:
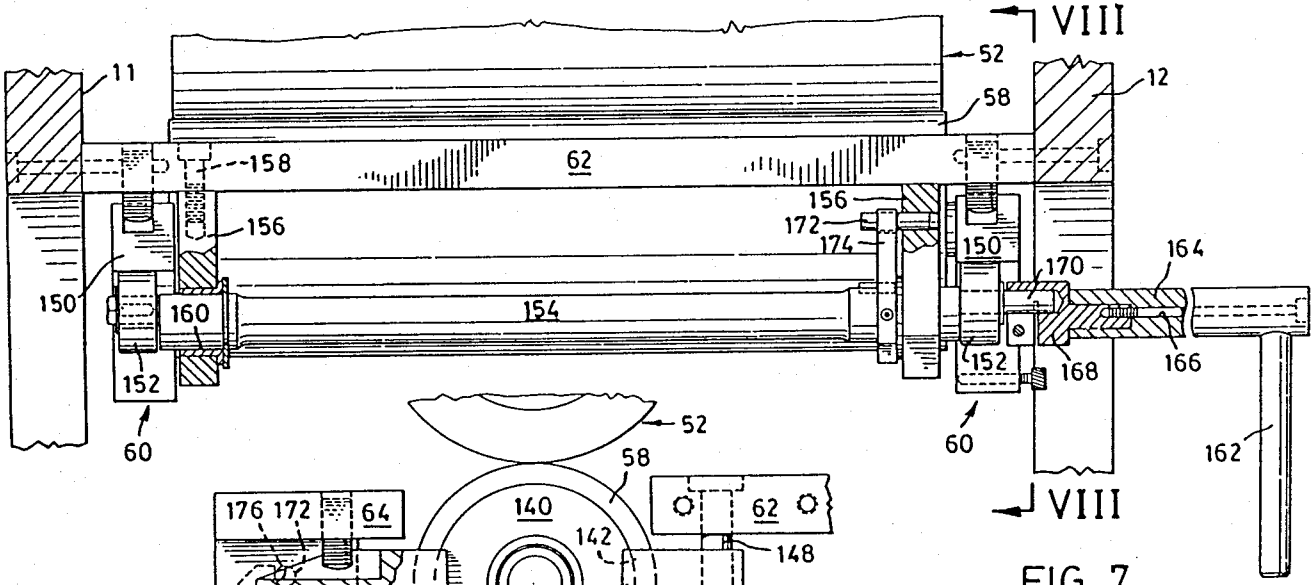
FIG. 7 is a vertical cross-section along the line VII—VII of FIG. 1 with parts broken away and illustrating the mounting of a pressure roller.
Figure 8:
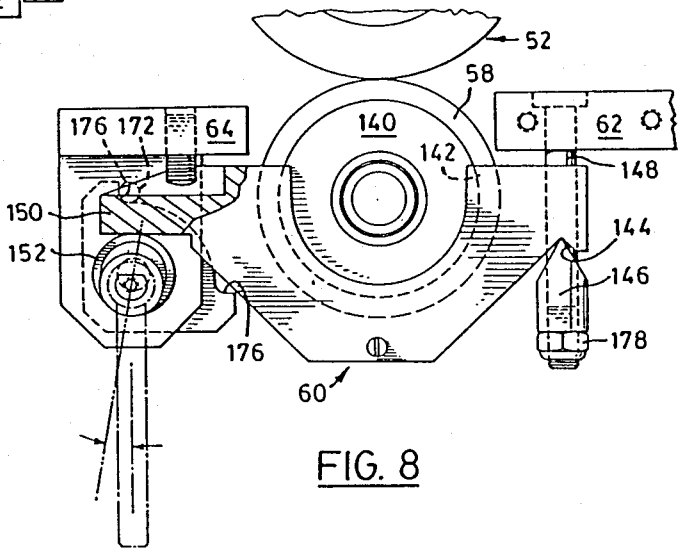
FIG. 8 is a cross-section along the line VIII—VIII of FIG. 7 with parts broken away.

Reference is next made to FIGS. 7 and 8 which illustrate in greater detail the mechanism for supporting the pressure roller 58. A pair of bearings, of which only one is illustrated and is indicated by reference numeral 140, are provided at opposite ends of the pressure roller 58 and the roller is journelled in these bearings. The bearings 140 are dropped into upwardly-open U-shaped grooves 142 formed in the cradles 60.

The cradles 60 are identical and similarly supported, and therefore only one of the cradles 60 and its support are illustrated.

Each of the cradles 60 is formed, at one side thereof, with a notch 144 of inverted V-shape, in which engages a wedge-shaped support 146 supported by a bolt 148 from the front paper support plate 62.

The other side of each of the cradles 60 is formed with a projecting portion 150, the underside of which rests on the periphery of a cylindrical cam 152, the two cams 152 being mounted eccentrically at opposite ends of a shaft 154.

A pair of support brackets 156, depending from the underside of the paper support plate 64, to which they are secured by bolts, one of which is indicated by reference numeral 158, are provided with bearings, one of which is indicated by reference numeral 160, for journalling the opposite ends of the shaft 154.

A handle 162 projecting laterally from an outermost end of a shaft 164 is secured by a bolt 166 to the outermost end of a connecting piece 168 which, in turn, is secured to a spigot 170 projecting from one end of the shaft 154 and axially offset therefrom, the handle 162 being provided for rotating the shaft 154 in the support brackets 156 and, thereby, for rotating the cams 152 to permit the cradles 60 to drop from their uppermost positions, in which they are shown in FIGS. 7 and 8 and in which the pressure roller 58 is pressed against the periphery of the electrostatically chargeable drum 52, to lowered positions, in which the pressure roller 58 is spaced from the drum 52.

The shaft 154 is limited to a maximum rotation of 90° by means of a stop pin 172, projecting inwardly from one of the support brackets 156, and an abutment plate 174, which is secured to the shaft 154 for rotation therewith and which is formed with two abutment shoulders 176 for cooperation with the stop pin 172.

The pressure between the pressure roller 58 and the drum 52, when the cradles 60 are in their uppermost positions, is adjustable by tightening or loosening nuts 178 in fitted engagement with the bolts 148 and supporting the underside of the wedge-shaped supports 146.

The toner hopper 74 was described earlier to some extent and is now to be described in greater detail with reference to FIGS. 9 and 10. The hopper comprises a frame member 180 mounted on the side walls 11 and 12 and supporting the toner hopper 74, the frame member 180 being formed with a rectangular opening 182 through which the toner powder can fall through the frame member 180 from the toner hopper 74.

The underside of the frame member 180 is formed with a pair of projections 184 located at opposite ends of the opening 182 and depending from the underside of the frame member 180, each of the projections being formed with an integral flange 186 provided with a slot 187, of which only one is shown. The projections 184 also have flat front faces 188 which are coplanar with the front flat face 190 of a lip 192, which depends from the underside of the frame member 180 along the front side of the rectangular opening or slot 182.

The front wall 82 of the toner hopper outlet 78 has a flat rear face 194, which is held in surface-to-surface contact with the faces 188 and 190 by securing bolts 196 provided with Belleville washers 198 and flat washers 200 and extending through slots 202 in the front wall 82 into threaded engagement with threaded holes 204 in the projections 184. As will be readily apparent, on loosening the bolts 196, the slots 202 allow the front wall 82 to be slid upwardly or downwardly relative to the projections 184 and, thus, adjusted in position relative to the periphery of the toner applicator cylinder 76.

For effecting such adjustment of the front wall, bolts 206, extending through openings 208 in the frame member 180 and in threaded engagement in openings (not shown) in the front wall 82, are provided with helical springs 210 interposed between the underside of the frame member 180 and the top of the hopper front wall 82 for spring-biasing the latter in a downward direction.

Figure 10:
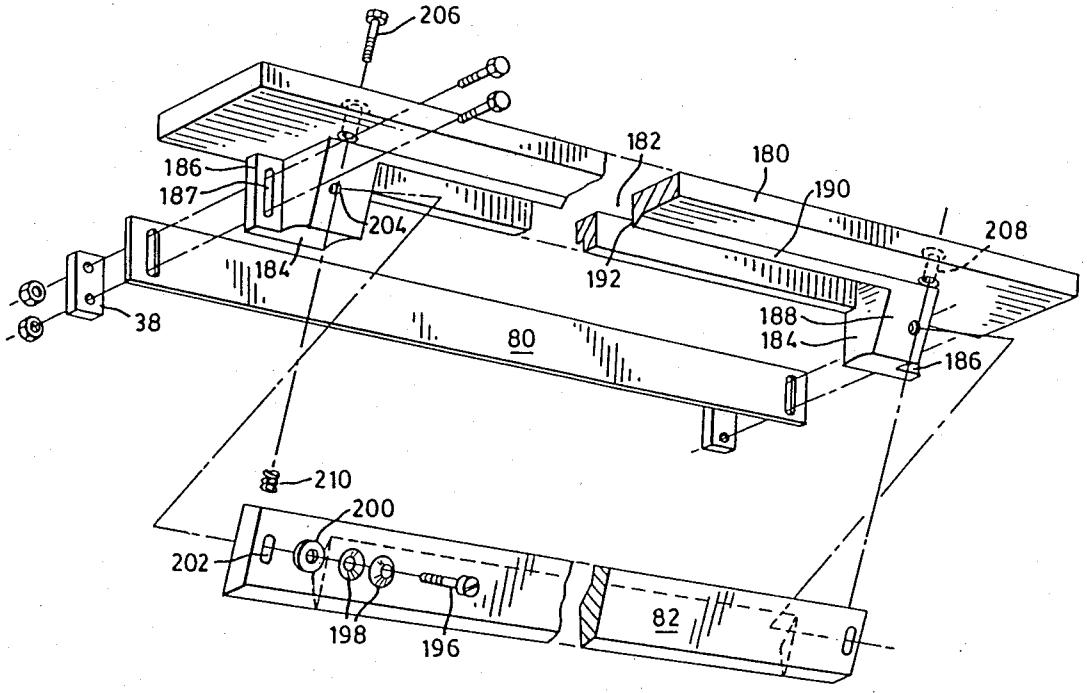
FIG. 10 is an exploded view, in perspective, of the toner powder hopper outlet of FIG. 9 and drawn generally from below and to the right of FIG. 9.

The front wall 82 is formed, on its rear surface, with a rearward projection 212 which, as can be seen from FIG. 9, has a triangular cross-sectional shape and on which the face 84 is formed and which, as can be seen from FIG. 10, extends the length of the wall 82 between the projections 184.

Figure 11:
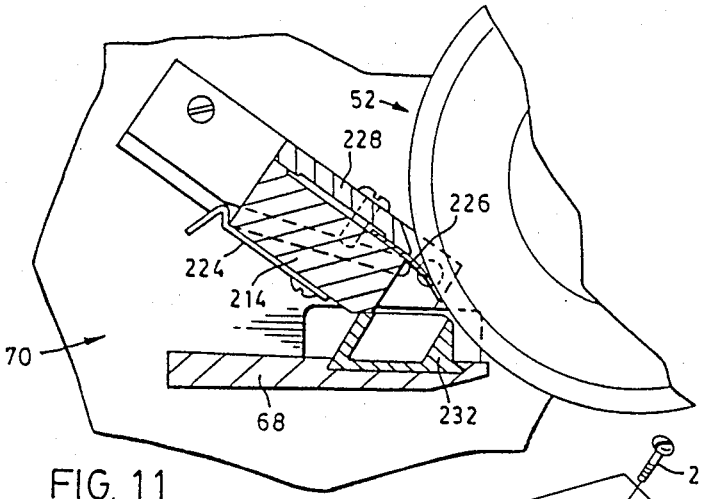
FIG. 11 is a vertical transverse cross-section through a scraper device for removing residual toner powder from the electrostatically chargeable drum of the apparatus shown in FIG. 1 and drawn to a larger scale.
Figure 12:
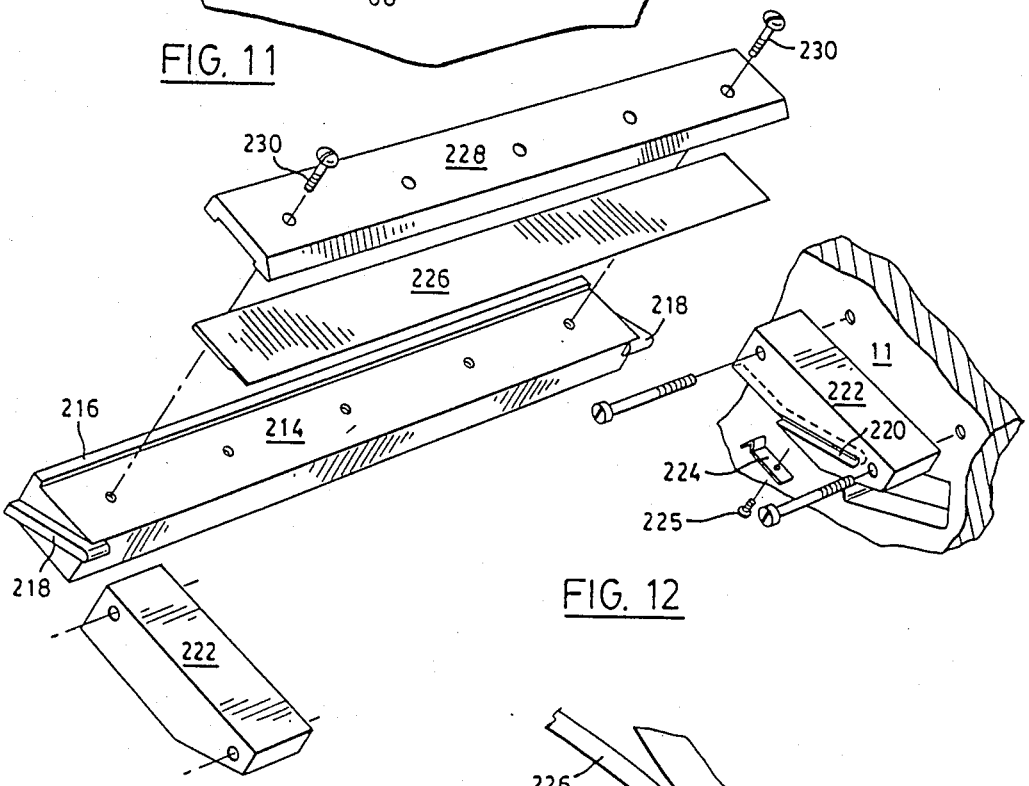
FIG. 12 shows an exploded view, in perspective, of the scraper device of FIG. 11 and drawn generally from above and to the right of FIG. 11.
Figure 13:
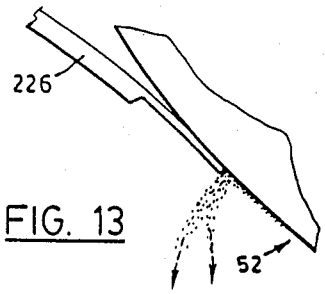
FIG. 13 is an enlarged diagrammatic view of part of a scraper blades, shown in FIGS. 11 and 12 in use against the drum periphery to remove toner.

The scraper 70 is described with reference in FIG. 1 will now be described in greater detail with reference to FIGS. 11 through 13. The scraper comprises a support bar 214 provided, along its rear top edge, with an abutment shoulder 216 and, projecting from opposite ends thereof, a pair of diagonal support projections 218, which are slidably engageable in opposed slots 220, only one of which is shown and which are formed in respective support blocks 222 bolted to the opposite side walls 11 and 12. A spring detent 224, secured by a screw 225 to the underside of one of the support blocks 222 and engageable with the lowermost rear edge of the support bar 214, serves to retain the support bar 214 relative to the support blocks 222 in a readily releasable manner.

A scraper blade 226 is releasably retained on the top of the support bar 214 by means of a backing strip 228 secured to the support bar 214 by screws 230. In operation, the scraper blade 226 is bent into sliding contact with the periphery of the drum 52 (as seen best in FIG. 13) so that its outer edge removes residual toner powder from the drum periphery. The powder then falls into a collecting tray 232 which is slidably supported on the paper guide plate 68 and can be withdrawn laterally of the apparatus 10 through an opening 234 in the side wall 11.

Figure 14:
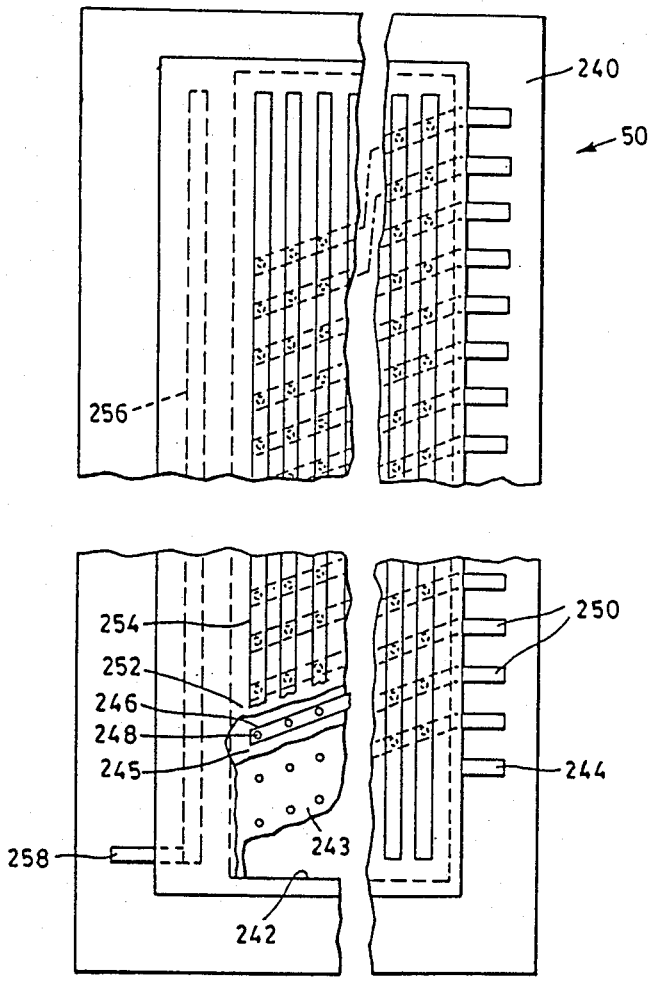
FIG. 14 is a diagrammatic and fragmented plan view of an insert consisting of an ion deposition matrix and erase head with parts broken away to show the construction of the insert.

Next, reference is made to FIG. 14 which shows the rectangular printing unit or insert 50 comprising the ion deposition matrix and erase-head. The insert includes a board 240 of insulating material formed with an opening 242 at the underside of the insert. A screen 243 extends over the opening 242 and has small apertures through which ions are discharged onto the drum dielectric layer 54 (FIG. 1) and which is connected to a contact tab 244 on the board 240. An intermediate apertured layer of insulating material 245 is provided between the screen and a plurality of slanted finger electrodes 246.

The finger electrodes 246 are formed with apertures 248 aligned with those in the screen and the electrodes are formed with contact tabs 250 and covered by a further insulating layer 252 interposed between the finger electrodes 246 and a plurality of drive electrodes 254 extending longitudinally of the insert 50, i.e. parallel to the axis of the drum 52.

The erase head is formed by a corona wire 256 provided with a contact tab 258.

When the insert 50 is located in the printing apparatus as described above, the spring-biased pins 53 engage the tabs 244, 250 and 258 for providing electrical contact to the printed circuit boards 16 which control the operation of the insert 50.

The manner of operation of the insert 50 will be readily apparent from the teachings of the aforesaid U.S. Pat. No. 4,160,257.

Figure 15:
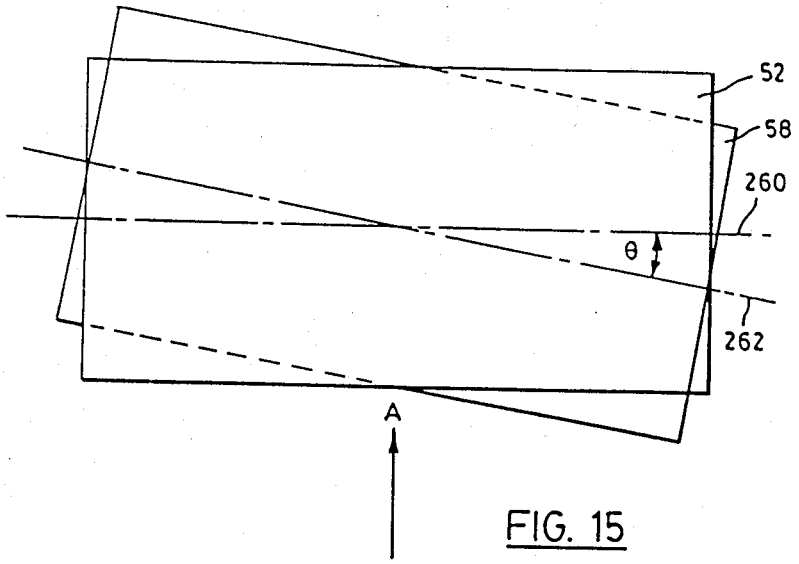
FIG. 15 is a diagrammatic top view of a drum or image cylinder and pressure roller or cylinder.

Reference is next made to FIG. 15 which illustrates diagrammatically the "skew" between the drum or image cylinder 52 and the pressure roller 58. The axes are arranged such that the axis 260 of the drum is offset from the axis 262 of the roller 58. The drum and roller may be adjusted by varying their angular relationship (in the vertical plane) at the ends. Alternatively, they may pivot around a central point of contact, by adjusting the offset of one of them about the axis of the other, this adjustment being equal at both ends. This latter, "end-to-end" skew is preferable and will be assumed hereinafter for illustrative purposes.

A measure of skew, is the angle between the projected axes 260, 262 as measured in the horizontal plane, or plane of paper feed. An illustrative value of skew to effect the objects of the invention is 0.10 inch, measured at the center of the drum and roller which are separated by a distance of 10.375 inch for 9 inch long rollers. This represents an angle of roughly 1.1°.

Figure 16:
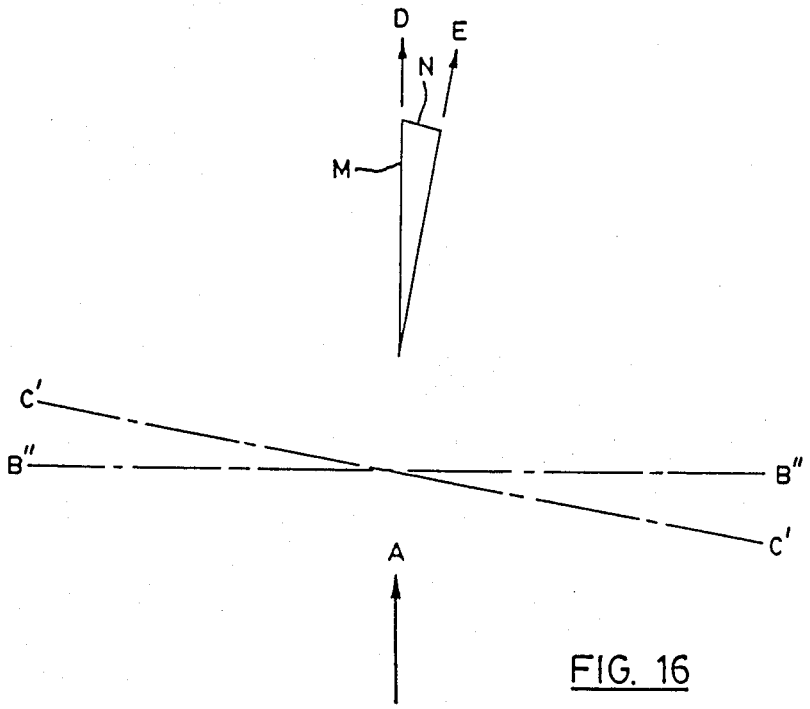
FIG. 16 is a sketch illustrating the relative forces and movements caused by the relationship shown in FIG. 15.

FIG. 16 is a geometric representation of the surface of contact of the drum and roller at the nip, showing the direction of paper feed before and after engagement. As a sheet of paper travels in direction A it enters the nip and it is subjected to divergent forces in direction D (perpendicular to the projected axis of the drum 52) and E (perpendicular to the projected axis of roller 58). Because of the relatively high smoothness and modulus of elasticity of the surface of the drum 52, the paper will tend to bind to or adhere to the roller, and therefore to travel in direction E. This results in a surface speed differential or "slip" between the surfaces of the paper and the drum 52.

Due to the compression of the roller 58 at the nip, paper will contact both roller surfaces over a finite distance M in direction D. The width of the contact area, M, can be calculated.

The embodiments of the invention in which an exclusive property or privilege is claimed are defined as follows:

1. In an electrostatic printing apparatus including:

an electrostatically chargeable cylinder;

means for forming a toner image on said electrostatically chargeable cylinder; and a pressure cylinder co-operating with said electrostatically chargeable cylinder;

the improvement comprising:

means for selectively displacing said pressure cylinder between a first position in which said pressure cylinder defines with said electrostatically chargeable cylinder a nip for receiving a sheet of copy material therebetween, and a second position, in which said pressure cylinder is spaced from said electrostatically chargeable cylinder; and means for adjusting the axis of said pressure cylinder relative to said electrostatically chargeable cylinder and thereby adjusting the locations of said first and second positions.

2. Apparatus as claimed in claim 1, further comprising a pair of cradle means at opposite ends of said pressure cylinder for supporting said opposite ends, each of said cradle means being supported at one side of said pressure cylinder by said displacement means and at the opposite side of said pressure cylinder by said adjustment means.

3. Apparatus as claimed in claim 2, wherein said displacement means comprise a pair of eccentric cams respectively associated with said cradle means.

4. Apparatus as claimed in claim 1, wherein said adjustment means comprise a pair of pivotal support means pivotally supporting respective ones of said cradle means and means for adjustably displacing said pivotal support means.

5. Apparatus as claimed in claim 4, wherein said cradle means include means defining upwardly tapered notches in the undersides of said cradle means, said pivotal support means comprising upwardly tapered support members engaging in said notches.

6. Apparatus as claimed in claim 1 in which the axis of the pressure cylinder is skewed with reference to the axis of the electrostatically chargeable cylinder.

* * * * *